US010935233B2

(12) United States Patent
Londerville

(10) Patent No.: US 10,935,233 B2
(45) Date of Patent: Mar. 2, 2021

(54) SWIRL STABILIZED HIGH CAPACITY DUCT BURNER

(71) Applicant: JOHN ZINK COMPANY, LLC, Tulsa, OK (US)

(72) Inventor: Stephen Londerville, Half Moon Bay, CA (US)

(73) Assignee: JOHN ZINK COMPANY, LLC, Tulsa, OK (US)

( * ) Notice: Subject to any disclaimer, the term of this patent is extended or adjusted under 35 U.S.C. 154(b) by 470 days.

(21) Appl. No.: 15/505,917

(22) PCT Filed: Aug. 25, 2015

(86) PCT No.: PCT/US2015/046754
§ 371 (c)(1),
(2) Date: Feb. 22, 2017

(87) PCT Pub. No.: WO2016/033084
PCT Pub. Date: Mar. 3, 2016

(65) Prior Publication Data

US 2018/0216814 A1 Aug. 2, 2018

Related U.S. Application Data

(60) Provisional application No. 62/042,157, filed on Aug. 26, 2014.

(51) Int. Cl.
*F23C 3/00* (2006.01)
*F23C 7/00* (2006.01)
*F23D 14/24* (2006.01)

(52) U.S. Cl.
CPC ..... *F23C 3/002* (2013.01); *F23C 7/004* (2013.01); *F23D 14/24* (2013.01); *F23C 3/006* (2013.01); *F23C 2900/03004* (2013.01)

(58) Field of Classification Search
CPC ..... F23C 2900/03004; F23C 3/002; F23C 3/006; F23C 7/004; F23D 14/24
See application file for complete search history.

(56) References Cited

U.S. PATENT DOCUMENTS 3,457,902 A * 7/1969 Gjerde ..... F01K 23/103 122/7 R
3,494,712 A 2/1970 Vosper et al.
(Continued)

FOREIGN PATENT DOCUMENTS

AT 395768 B * 3/1993 ..... F23D 14/70
CA 1169753A C 6/1984
(Continued)

OTHER PUBLICATIONS

International Search Report & Written Opinion for corresponding patent application No. PCT/US2015/046754, dated Oct. 28, 2015. (11 pages).

*Primary Examiner* — Jorge A Pereiro
*Assistant Examiner* — Logan P Jones

(57) ABSTRACT

The present disclosure includes air spinners for use in duct burners, and duct burners and duct burner kits including a plurality of air spinners. Air spinners may include a plurality of blades extending radially outward from a fuel path and configured to impart rotation to air flowing between the blades, where the air spinner is configured to be coupled to a fuel runner of a duct burner such that the air spinner encircles a fuel outlet of the fuel runner with the axis of the fuel path extending at a non-parallel angle from an axis of the fuel runner. Duct burners can comprise a plurality of air spinners coupled to a plurality of fuel runners. Duct burner kits can comprise a plurality of air spinners configured to be coupled (e.g., without welding) to a plurality of fuel runners.

14 Claims, 7 Drawing Sheets

(56) References Cited

U.S. PATENT DOCUMENTS 3,586,242 A * 6/1971 Woolard ..... F23D 14/24 239/406
3,649,211 A 3/1972 Vosper
3,682,451 A 8/1972 Vosper
3,739,989 A 6/1973 Vosper
3,830,620 A * 8/1974 Martin ..... F23D 14/045 431/350
3,843,309 A * 10/1974 Lambiris ..... F23B 5/00 431/284
3,890,084 A 6/1975 Voorheis et al.
4,286,945 A 9/1981 Vosper et al.
4,301,747 A 11/1981 Lockwood, Jr.
4,303,386 A 12/1981 Voorheis et al.
4,310,299 A 1/1982 Binasik et al.
4,375,952 A 3/1983 Vosper et al.
4,387,654 A 6/1983 Binasik et al.
4,462,795 A 7/1984 Vosper et al.
4,511,325 A 4/1985 Voorheis
4,685,882 A 8/1987 Binasik et al.
4,726,761 A 2/1988 Binasik et al.
4,737,100 A 4/1988 Schnell et al.
4,767,319 A 8/1988 Vosper
5,099,879 A 3/1992 Baird
5,102,329 A 4/1992 Lifshits
5,224,539 A 7/1993 Lifshits
5,310,337 A 5/1994 Lifshits et al.
5,433,600 A * 7/1995 Jeng ..... F23C 7/02 431/177
5,460,512 A 10/1995 Lifshits et al.
6,267,585 B1 * 7/2001 Suttrop ..... F23D 14/20 239/420
6,301,875 B1 10/2001 Backlund et al.
6,453,852 B1 9/2002 Lifshits et al.
6,468,073 B1 * 10/2002 Weidman ..... F23D 14/20 431/350
6,929,470 B1 8/2005 Lifshits et al.
9,909,462 B2 * 3/2018 Polonsky ..... F22B 1/1815
2008/0083229 A1 * 4/2008 Haynes ..... F02C 3/28 60/776
2016/0061110 A1 3/2016 Whelan

FOREIGN PATENT DOCUMENTS

CA 2288420 C 5/2007
DE 4301779 A1 * 7/1994 ..... F23D 14/24
NL 8300486 A * 9/1984 ..... F23D 14/34
WO WO2013087919 A1 6/2013

* cited by examiner

SWIRL STABILIZED HIGH CAPACITY DUCT BURNER

CROSS-REFERENCE TO RELATED APPLICATIONS

This is a 371 application of PCT/US2015/046754 filed Aug. 25, 2015, which claims priority to U.S. Provisional Patent Application No. 62/042,157, entitled "SWIRL STABILIZED HIGH CAPACITY DUCT BURNER," filed Aug. 26, 2014, the disclosure of which is incorporated herein by reference in its entirety.

FIELD

The present invention is related generally to duct burners and more particularly, but not by way of limitation, to high-capacity duct burners.

BACKGROUND

Very large duct burner assemblies are used in a variety of applications and circumstances. In some applications, such duct burners and corresponding ducts may have dimensions on the order of sixty (60) feet in height and thirty (30) feet in width, and may channel airflow at velocities on the order of fifty (50) feet per second (ft/s). Some burners are used to generate electricity in combined cycle systems, which typically utilize a gas turbine and steam generation to produce electricity. In such systems, duct burners are typically used to reduce oxygen in the air or turbine exhaust gas (TEG) via combustion and heat the airstream, for which spatial uniformity of generated thermal energy may be desirable. Other duct burners are used to generate large amounts of heated air for drying products such as, for example, food and/or paper products.

In typical very large duct burner systems, combustion air mass flow (which can include fresh air or, in most instances, turbine exhaust gas (TEG)) flows through a duct that typically includes fuel runners extending across the duct. Uniform heat generation across the duct is often desirable for efficiency and usefulness of the mass flow.

Conventional duct burners typically attempt to achieve uniform heat generation by attempting to improve the uniformity of airflow across the duct burner, and by including multiple fuel runners across the duct. Some prior art fuel burners include fuel outlets (often including simple holes or nozzles) arranged at multiple locations along each runner, typically spaced at equal intervals, to form a flame grid across the duct that generates thermal energy (heat) relatively uniformly the duct. These type of conventional duct burners typically include numerous runners and numerous fuel outlets in each runner, which may, for example, include several hundred fuel outlets and flames in a single duct burner. Conventional duct burners may also include baffles that run alongside and between the runners to increase the velocity of the mass flow (airstream) across the fuel runners. Duct air or TEG coming from a turbine, for example, often moves at a low velocity which can result in a lazy, non-efficient flame.

SUMMARY

Prior art runners and fuel outlets can be expensive to manufacture and maintain because each fuel runner may require multiple holes, injectors, valves, gauges, inlets, scanners, pilots, etc. Similarly, the large number of baffles required by the large number of fuel runners in prior art duct burners, while not as expensive as runners, add components and therefore cost, for manufacturing and maintaining duct burners. Additionally, the length of a duct housing for a duct burner is partly dictated by the length of the flame generated by the burner fuel outlets or nozzles. Given the very large size of the ducts for which such duct burners are configured to operate, the ability to reduce the length of the duct to conserve cost would beneficial. A duct burner with a reduced number of fuel outlets, runners, and components, while still maintaining a relatively uniform heat generation across the duct, is desirable. It is also desirable to reduce the length of the burner flame to ultimately shorten the length of the duct.

The present burners for use in a high capacity duct burner system include air spinners located about fuel outlets spaced along fuel runners, which air spinners are configured to control flame length and stability, and uniformly distribute produced heat across the duct. At least some embodiments of the present spinners allow for larger-diameter but shorter length flames from each fuel outlet, which can ultimately reduce the number of burner components, including, for example, the number of runners and baffles, and the components of each runner (e.g., fuel nozzles, pipes, inlets, pilot lights, gauges, scanners, and/or the like). Fewer runners and components can also reduce manufacturing and maintenance costs. The present spinners and burners can reduce these components and costs while improving uniformity of heat generation across the burner, and shortening the length of the flame from each fuel outlet (and thus the length of the duct), without an adverse pressure drop across the burner of the duct.

Some embodiments of the present burners (e.g., for use in a duct burner system having a duct) comprise: a frame defining an opening extending between an inlet first end and an outlet second end, the frame configured to be coupled to the duct such that air flowing through the duct will flow through the opening in a downstream direction from the first end to the second end; a plurality of fuel runners coupled to the frame and extending across the opening of the frame, each of the plurality of fuel runners including a sidewall defining a fuel channel and a plurality of fuel outlets along a length of the fuel runner, each of the plurality of fuel outlets in communication with the fuel channel and extending through the sidewall; and a plurality of air spinners each comprising a plurality of blades extending radially outward from a fuel path having an axis, the plurality of blades configured to impart rotation to air flowing between the blades; where each of the plurality of air spinners is coupled to one of the plurality of fuel runners such that the air spinner encircles one of the plurality of fuel outlets with the axis of the fuel path extending at a non-parallel angle from an axis of the fuel runner.

In some embodiments of the present burners, each of the plurality of air spinners is coupled to one of the plurality of fuel runners such that the axis of the fuel path extends at a perpendicular angle from the axis of the fuel runner.

In some embodiments of the present burners, the plurality of air spinners extend from a downstream side of the fuel runners that is configured to face in a downstream direction of the duct.

Some embodiments of the present burners further comprise: a plurality of nozzles each coupled to one of the fuel runners in communication with one of the plurality of fuel outlets. In some embodiments, each nozzle comprises a body having a sidewall that defines a nozzle channel extending between an open first end and a substantially closed second end, the first end coupled to the fuel runner with the nozzle channel in communication with the fuel outlet, the body defining a plurality of fuel passages extending through the sidewall at a non-parallel angle to an axis of the nozzle channel. In some embodiments, each of the plurality of nozzles is configured such that axes of the plurality of fuel passages do not intersect the axis of the nozzle channel. In some embodiments, each of the plurality of nozzles is configured such that the axes of the plurality of fuel passages are tangential to a circular cylinder centered on the axis of the nozzle channel. In some embodiments, each of the plurality of nozzles is mechanically coupled to the fuel runner via threads.

Some embodiments of the present burners further comprise: a plurality of baffles coupled to the frame and extending across the opening of the frame parallel to the plurality of fuel runners, at least some of the plurality of baffles each disposed between two of the fuel runners. In some embodiments, the baffles are located between the first end of the frame and of the blades of the air spinners, and between the fuel runners and the second end of the frame.

Some embodiments of the present burner kits (e.g., for use in a high capacity burner duct system having a duct) comprise: a plurality of fuel runners configured to be coupled to the duct such that the fuel runners extend across a channel of the duct, each of the plurality of fuel runners including a sidewall defining a fuel channel and a plurality of fuel outlets along a length of the fuel runner, each of the plurality of fuel outlets in communication with the fuel channel and extending through the sidewall; and a plurality of air spinners each comprising a plurality of blades extending radially outward from a fuel path having an axis, the plurality of blades configured to impart rotation to air flowing between the blades; where each of the plurality of air spinners is configured to be coupled to one of the plurality of fuel runners such that the air spinner encircles one of the plurality of fuel outlets with the axis of the fuel path extending at a non-parallel angle from an axis of the fuel runner.

In some embodiments of the present burner kits, each of the plurality of air spinners is configured to be coupled to one of the plurality of fuel runners such that the axis of the fuel path extends at a perpendicular angle from the axis of the fuel runner.

Some embodiments of the present burner kits further comprise: a plurality of nozzles each configured to be coupled to one of the fuel runners in communication with one of the plurality of fuel outlets. In some embodiments, each nozzle comprises a body having a sidewall that defines a nozzle channel extending between an open first end and a substantially closed second end, the first end coupled to the fuel runner with the nozzle channel in communication with the fuel outlet, the body defining a plurality of fuel passages extending through the sidewall at a non-parallel angle to an axis of the nozzle channel. In some embodiments, each of the plurality of nozzles is configured such that axes of the plurality of fuel passages do not intersect the axis of the nozzle channel. In some embodiments, each of the plurality of nozzles is configured such that the axes of the plurality of fuel passages are tangential to a circular cylinder centered on the axis of the nozzle channel. In some embodiments, each of the plurality of nozzles is configured to be mechanically coupled to the fuel runner via threads.

Some embodiments of the present air spinners (for use in a duct burner) comprise: a hub defining a fuel path having an axis; a plurality of blades extending radially outward from the hub, the plurality of blades configured to impart rotation to air flowing between the blades; where the air spinner is configured to be coupled to a fuel runner of a duct burner such that the air spinner encircles a fuel outlet of the fuel runner with the axis of the fuel path extending at a non-parallel angle from an axis of the fuel runner.

Some embodiments of the present air spinners further comprise: a nozzle configured to extend through the hub and be coupled to the fuel runner in communication with the fuel outlet. In some embodiments, the nozzle comprises a body having a sidewall that defines a nozzle channel extending between an open first end and a substantially closed second end, the first end configured to be coupled to the fuel runner with the nozzle channel in communication with the fuel outlet, the body defining a plurality of fuel passages extending through the sidewall at a non-parallel angle to an axis of the nozzle channel. In some embodiments, the nozzle is configured such that axes of the plurality of fuel passages do not intersect the axis of the nozzle channel. In some embodiments, the nozzle is configured such that the axes of the plurality of fuel passages are tangential to a circular cylinder centered on the axis of the nozzle channel. In some embodiments, the nozzle is configured to be mechanically coupled to the fuel runner via threads. In some embodiments, the nozzle is unitary with the hub.

In some embodiments of the present air spinners, the blades have a maximum transverse dimension of at least 18 inches (e.g., at least 24 inches, between 18 and 36 inches, and/or the like).

The foregoing has outlined rather broadly certain features and technical advantages of the present disclosure in order that the detailed description of the disclosure that follows may be better understood. Additional features and advantages of the disclosure are described below. It should be appreciated by those skilled in the art that the conception and specific embodiments disclosed may be readily utilized as a basis for modifying or designing other structures for carrying out the same purposes of the present disclosure, without departing from the spirit and scope of the disclosure as set forth in the claims. The features that are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION

The present invention provides a duct burner with fuel runners having a plurality of fuel outlets and that extend across a duct, and air spinners coupled to the fuel runners about the fuel outlets to impart rotation to air flowing through the air spinners. At least some embodiments of the present spinners include multiple fixed blades disposed around and encircling a fuel outlet such that the spinners spin the mass flow traveling through the spinners to produce shortened and widened burner flames within the duct to produce near uniform heat generation across the duct.

Figure 1A:
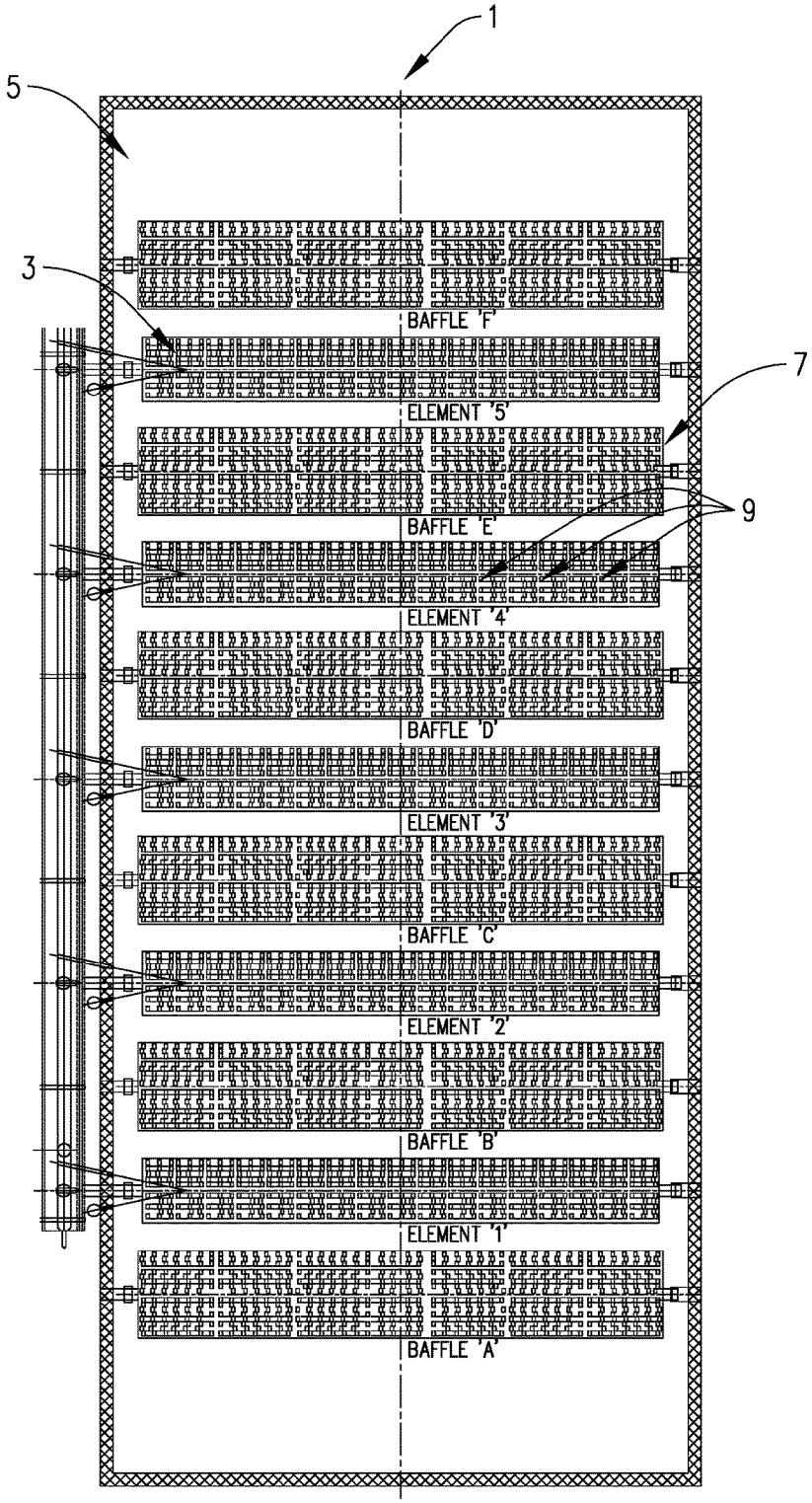
PRIOR ART FIG. 1A
FIGS. 1A and 1B show front and side views, respectively, of a conventional prior art duct burner.
Figure 1B:
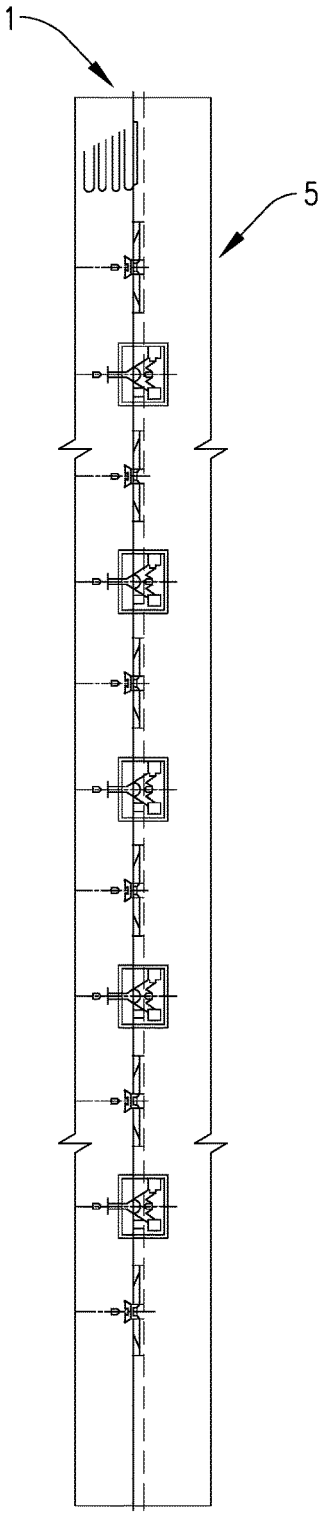
PRIOR ART FIG. 1B

FIGS. 1A and 1B show front and side views, respectively, of a prior art conventional duct burner 1 comprising fuel runners 3 extending across a duct 5, and baffles 7 extending parallel to and between fuel runners 3. Fuel runners 3 include a plurality of fuel outlets 9 arranged along and in communication with the interior channel of each fuel runner 3. In use, mass flow, which can be TEG or combustion air, flows through duct 5 across fuel runners 3, and fuel is ejected from fuel outlets 9. Fuel from each of fuel outlets 9 is ignited and hundreds of small flames burn across the duct burner in a grid pattern, providing relative heating across the area of the duct.

Figure 2:
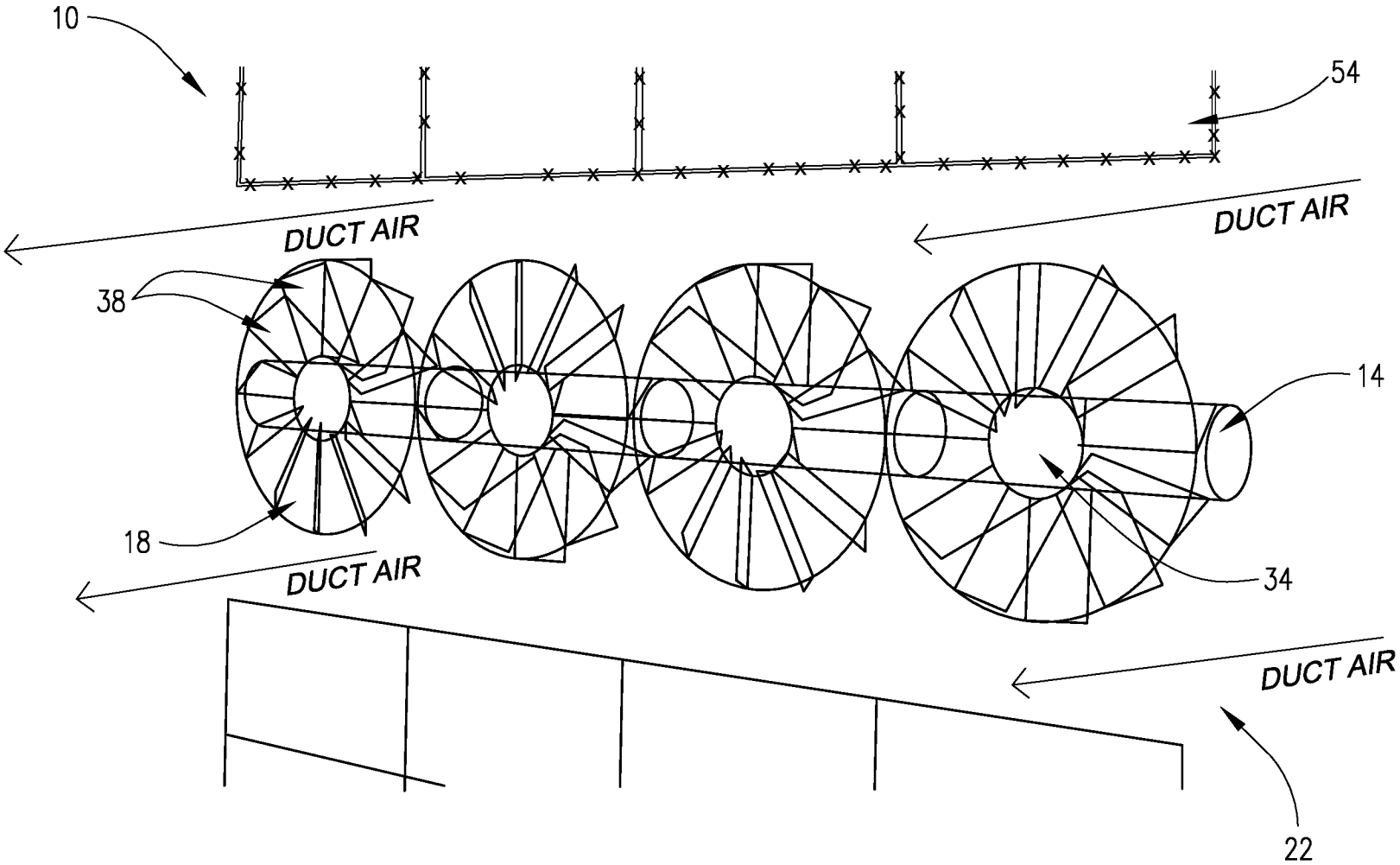
FIG. 2 shows a schematic perspective view of first embodiment of a fuel runner and a plurality of air spinners in accordance with the present invention.
Figure 3:
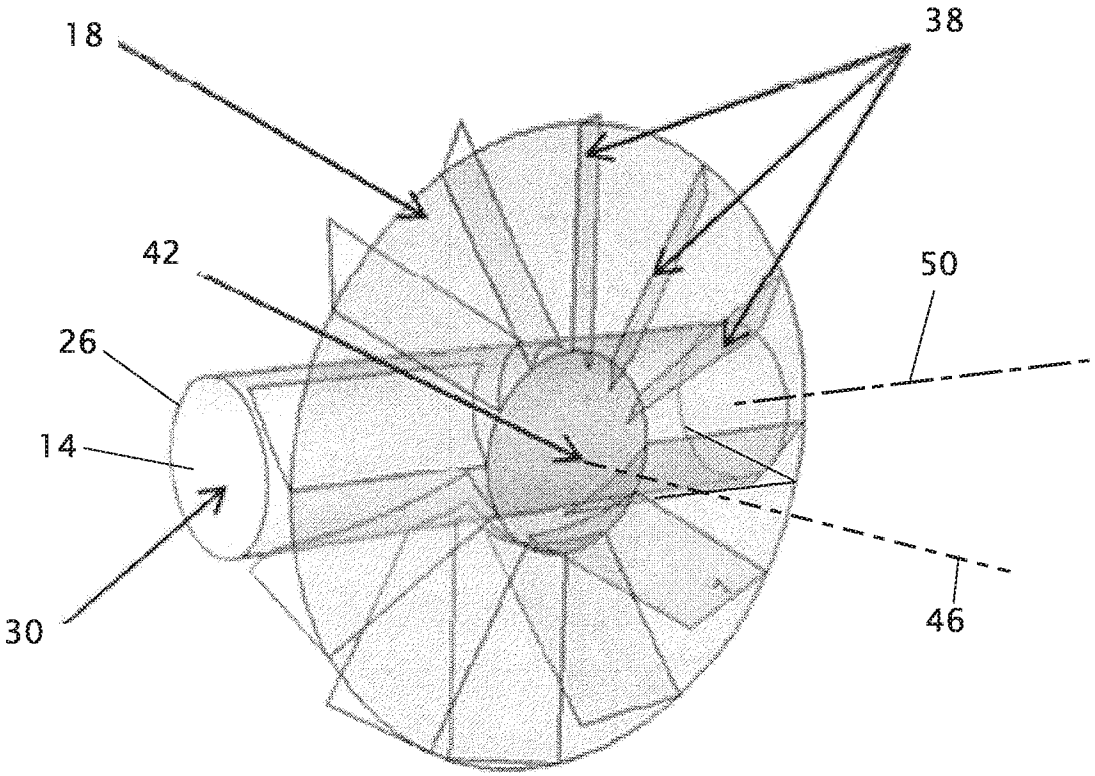
FIG. 3 shows an enlarged schematic perspective view of a single one of the spinners and a portion of the fuel runner of FIG. 2.

FIG. 2 and FIG. 3 show schematic perspective views of a portion of a first embodiment 10 of the present duct burners having a fuel runner 14 and a plurality of air spinners 18, with FIG. 3 showing an enlarged view of a single spinner 18 and corresponding portion of fuel runner the of FIG. 2. In the embodiment shown, fuel runner 14 is configured to extend laterally (e.g., horizontally) across duct 22. In this embodiment, fuel runner 14 includes a sidewall 26 defining a fuel channel 30 and a plurality of fuel outlets 34 along a length of the fuel runner. As shown, a plurality of fuel outlets 34 are in fluid communication with fuel channel 30 and extend through sidewall 26 of the fuel runner. In this embodiment, air spinners 18 each comprise a plurality of blades 38 extending radially outward from a fuel path 42, with blades 38 being fixed and configured to impart rotation to air flowing between the blades. In the embodiment shown, air spinners 38 are coupled to fuel runner 14 such that the air spinner encircles one of fuel outlets 34 on a downstream side of the fuel runner (such that duct air flows in a direction from fuel runner to spinner, as indicated by the arrows in FIG. 2 that indicate the direction of flow of duct air). Spinners 18 are referred to as "air" spinners because they are configured to spin or rotate combustion air, such as TEG, but the use of "air" spinners does not imply that only atmospheric air may be used. Rather, air spinners 18 are configured to and are suitable imparting spin or rotation to any of various gases that may flow through duct burners. As shown, fuel runner 14 can be configured to support multiple air spinners across the width of a duct (e.g., 30 feet) and can have a diameter (e.g., between 4 and 8 inches, 6 inches, or larger) and a wall thickness (e.g., schedule 40) sufficient to structurally support the air spinners.

In the embodiment shown, air spinners 18 are coupled to fuel runner 14 such that a central axis 46 of each air spinner 18 is disposed perpendicular to and intersecting a central axis 50 of fuel runner 14. As shown, blades 38 are disposed at a non-perpendicular and non-parallel angle relative to the direction of flow of duct air, such that combustion duct air flowing through duct 22 flow between spinner blades 18 and is rotated (spun or swirled) by the angled blades 38. While blades 38 extend radially outward from fuel path 42 (and the corresponding fuel outlet 34), a longitudinal axis of each individual blade 38 need not intersect the central axis 46 of the air spinner 18. In particular, in some embodiments, each blade 38 may be angled relative to a line extending outward perpendicularly from the central axis (46) of the air spinner (18), such that, for example, a longitudinal axis of each blade is tangential to a circle centered on axis 46. Multiple configurations of blades 18 are possible that can include differing the angle, length, number, and/or profile of the blades. For example, blades 38 can be provided with any of various blade profiles, such as, for example, curved, straight, tapered, arced, and/or any of various other profiles. In some embodiments, the blade profile may vary along a length of blade. By way of further examples, some embodiments of the present air spinners can comprise between 5 and 15 blades (e.g., between 6 and 12 blades).

In the embodiment shown, duct burner 10 also includes baffles 54 between fuel runners 14 to occupy or take up space within duct 22 to increase the velocity of the duct air as it flows through the duct and thereby help to ensure that the flame from the burner is not lazy. Baffles 54 may, for example, comprise sheet metal spacers that run alongside and parallel to fuel runners 14 across duct 22, as shown.

Fuel outlets 34 can comprise a nozzle or merely a hole and, in some embodiments, may comprise multiple holes or nozzles. In some embodiments, fuel outlets 34 are complementary to the spin or rotation of duct air by blades 38 in that fuel may be injected with spin, such as, for example, tangentially to a fuel outlet outer diameter so the injected fuel effectively spins or rotates with the duct air that is rotated by blades 38. For example, a "spinning" gas nozzle can have an outer diameter of nine (9) inches and can include a plurality of nozzle passages that exit tangentially to the outer diameter. In at least some embodiments, the nozzle ejects fuel downstream of blades 38; however, in other embodiments, fuel may be ejected upstream or within the blades.

For example, in some embodiments (such as the one depicted in FIGS. 4-6), each nozzle coupled to a fluid outlet 34 can include a closed end and a plurality of lateral fuel passages that are angled to cause fuel to be ejected laterally outward in a direction that is similar (e.g., tangential) the direction of rotation of air passing through the corresponding air spinner. This type of spinning gas injection can provide further energy to the spinning duct air flowing out of the corresponding air spinner 18 to assist with flame control and strength, such as, for example, if duct air flow energy is insufficient to alone optimize combustion, or if additional baffles 54 cannot be added (e.g., due to space constraints or because the baffles cause an undesirable level of back pressure, which can damage the turbine upstream of the burner). In some embodiments, this type of spinning gas injection, in conjunction with the present air spinners and configured as provided above, may result in a level of back pressure that is equivalent to or substantially the same as a conventional duct burner.

In operation, combustion air flows through duct 22 across runners 14 and air spinners 18 while fuel is ejected from fuel outlets 34. As it flows through fixed blades 38, the duct air is forced to spin in a circular vortex pattern about each fuel outlet 34. The fuel from each fuel outlets 34 is ignited, and the spinning or swirling duct air along with the fuel ejected from the fuel outlets, causes a short bushy flame. The larger (relative to prior art conventional burners) fuel outlets 34 and air spinners 18 result in several medium sized flames across the duct burner in a grid pattern, providing relative heating across duct 22.

In contrast with prior art conventional duct burners, embodiments of the present duct burners can, for example, have fuel runners spaced four (4) feet apart instead of two (2) feet apart. In at least some embodiments, the present air spinners can have a maximum transverse dimension (e.g., outer diameter) diameter on the order of at least 24 inches, e.g., 32 inches to 36 inches, to generate a short bushy flame. Spinning injection of fuel, as described above, instead straight injection via a simple hole or nozzle, further promotes the production of a strong and short, bushy flame.

The present duct burners may comprise four (4) to five (5) fuel runners with six (6) to seven (7) burners on each fuel runner, instead of ten (10) to twelve (12) runners with hundreds of fuel outlets as may be found in prior art conventional duct burners. This results in fewer components, and thus lower cost, as well as fewer obstacles in the path of duct air. Rather than numerous tiny flames being generated from hundreds of fuel outlets, a smaller number of larger (e.g., medium-sized) short bushy flames are produced to produce the desired relative uniform heat generation across the duct. The fewer fuel outlets decreases manufacturing costs because one the order of approximately 20 holes are drilled in runners, rather than hundreds (e.g., 300) of holes as in prior art conventional burners. Finally, the shorter flame produced by the present air spinners (e.g., in conjunction with the present spinning fuel injection), allows for a shorter overall duct length and lower cost for the materials and manufacture of the housing or frame. Additionally, the larger-diameter spinners also occupy or take up some of the space that would otherwise be occupied by baffles in conventional duct burners such that fewer and smaller baffles may be used with a similar pressure drop of approximately 0.01 psig, as in the prior art example provided above. Finally, the present duct burners can increase firing capacity (relative to prior art conventional duct burners) from 3 million BTU/hr-ft (MM BTU/hr-ft) to as much as 10-12 MM BTU/hr-ft.

Figure 4:
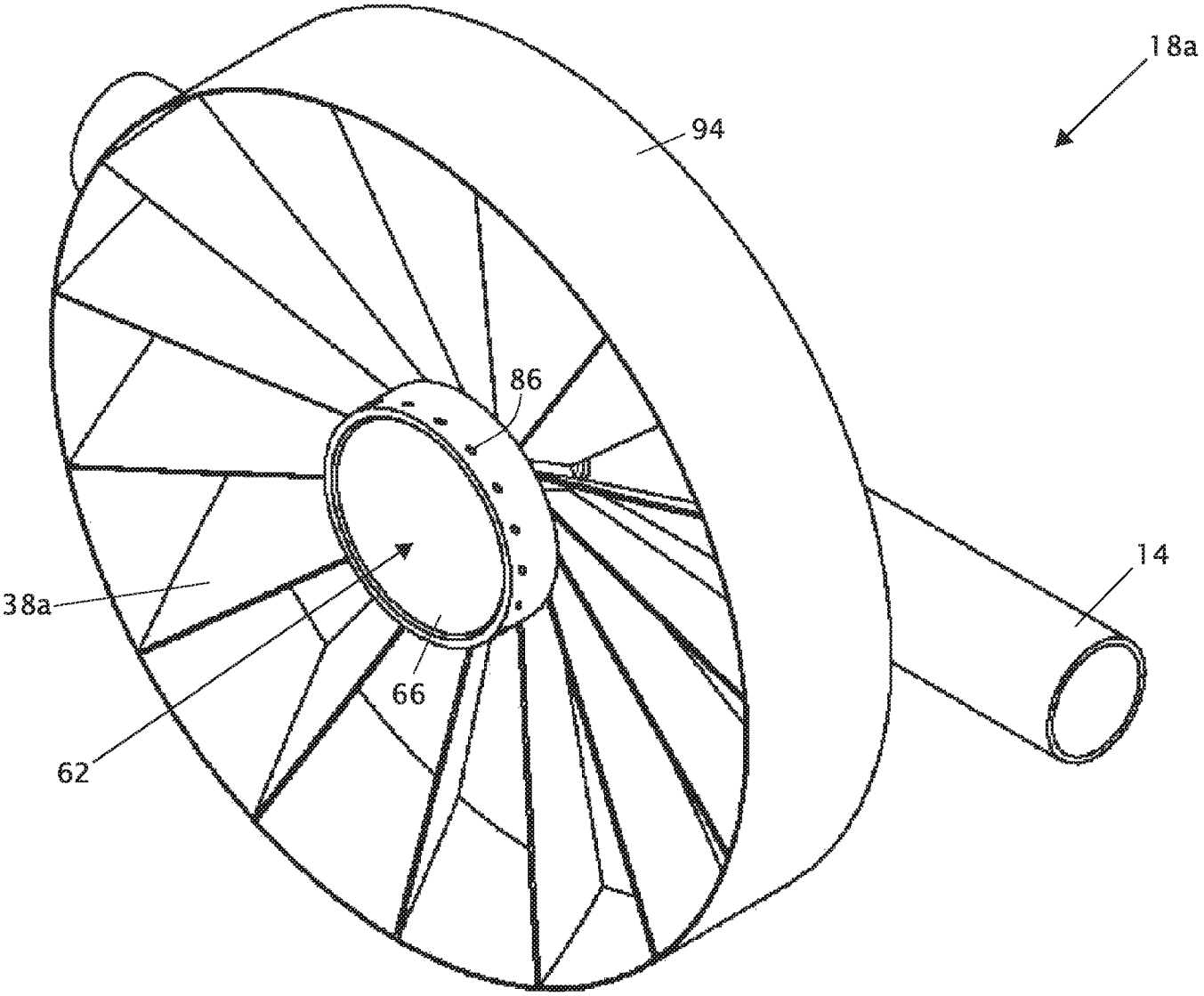
FIG. 4 shows an enlarged perspective view of a second embodiment of one of the present air spinners.
Figure 5:
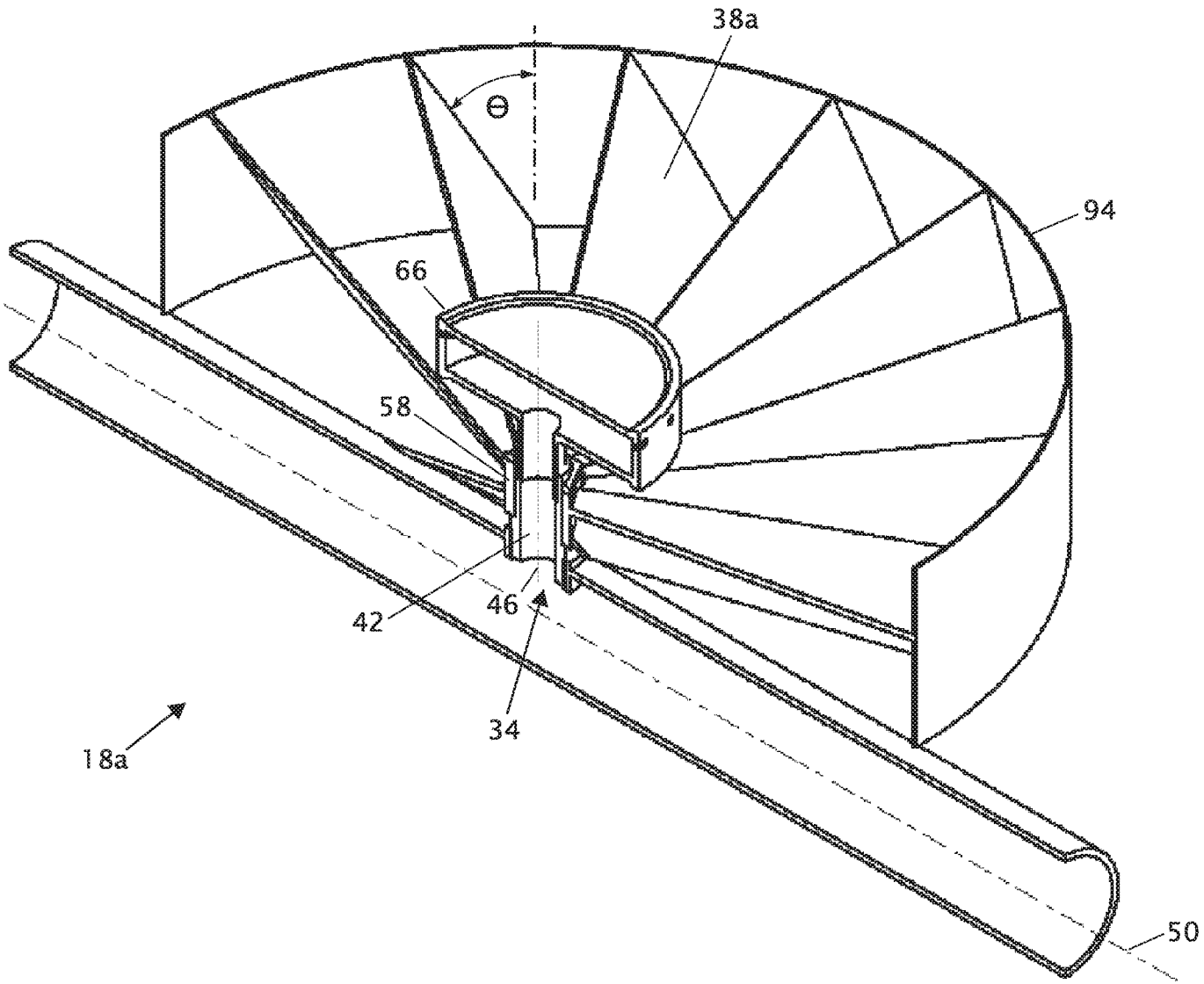
FIG. 5 shows a cross-sectional perspective view of the spinner of FIG. 4.
Figure 6:
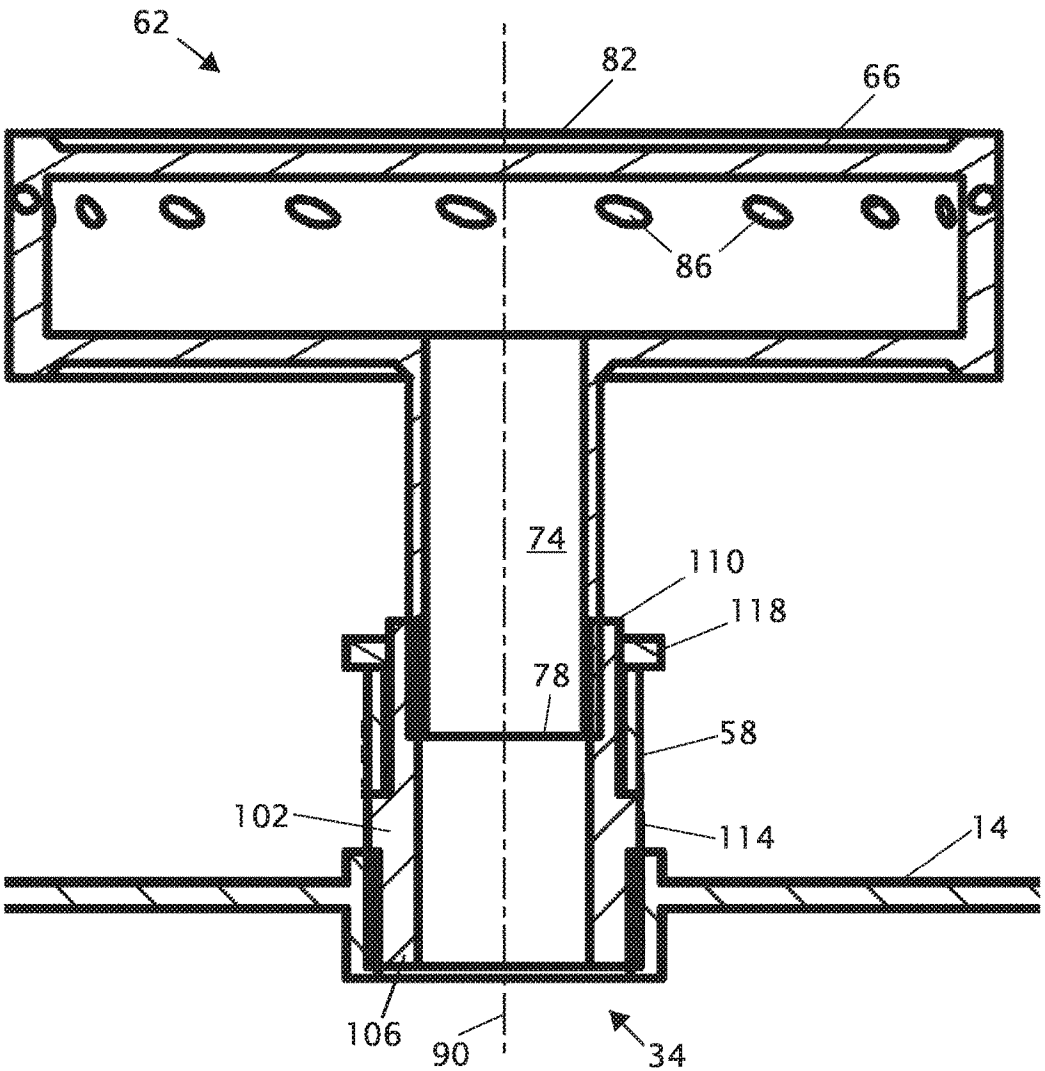
FIG. 6 shows a partially cutaway, cross-sectional side view of a nozzle of the spinner of FIG. 4.

FIGS. 4-6 depict a second embodiment **18*a* of the present air spinners in conjunction with a portion of a fuel runner 14 to which the air spinner is coupled. As described above for air spinner 18, air spinner 18*a* comprises a plurality of blades 38*a* extending radially outward from a fuel path 42 having an axis 46, and the plurality of blades are configured to impart rotation to air flowing between the blades (blades 38*a* are omitted in FIG. 6 to more-clearly reveal other features). As shown, air spinner 18*a* is coupled to fuel runner 14 such that the air spinner encircles a fuel outlet 34 with axis 46 at a non-parallel (e.g., perpendicular) angle relative to axis 50 of the fuel runner. In the embodiment shown, air spinner 18*a* further comprises a hub 58 defining the fuel path 42 and from which blades 38*a*** extend.

In the embodiment shown, a nozzle 62 extends through hub 58 and is coupled to fuel runner 14 in communication with fuel outlet 34. More particularly, in this embodiment, nozzle 62 comprises a body 66 having a sidewall 70 that defines a nozzle channel 74 extending between an open first end 78 and a substantially closed second end 82. In this embodiment, first end 78 is configured to be coupled to fuel runner 14 with nozzle channel 74 in communication with fuel outlet 34, and the body (66) defines a plurality of fuel passages 86 extending through the sidewall (70) at a non-parallel angle to an axis 90 of the nozzle channel. In the configuration shown, when nozzle 62 is coupled to the fuel runner, axis 90 is coaxial with axis 46 of fuel path 42 of the corresponding air spinner (18).

In the depicted embodiment of nozzle 62, second end 82 is larger (e.g., has a larger diameter, as shown) than first end 78 of nozzle 62. In this configuration, fuel passages 86 can be offset such that the axes of the fuel passages do not intersect axis 90 of the nozzle channel. For example, in the embodiment shown, the axes of the fuel passages are tangential to a circular cylinder centered on axis 90 of the nozzle channel, such as, for example, the circular cylinder defined by the interior surface of sidewall 70 adjacent second end 82. This configuration, in which fuel passages 86 are offset from axis 90 and angled relative to lines extending radially outward from axis 90, enables the "spinning" injection of fuel as described above, by directing fuel outward in a clockwise or counterclockwise direction around axis 90 to encourage the spinning or rotation of duct air imparted by air spinners 18. In the embodiment shown, fuel passages 86 are also angled in a downstream direction extending from first end 78 toward second end 82 of nozzle at between 65 and 85 degrees relative to axis 90. In other embodiments, fuel passages 86 may be disposed at a lesser angle (e.g., between 20 and 65 degrees) relative to axis 90, a greater angle (e.g., between 85 and 89 degrees) relative to axis 90, or perpendicular to axis 90. In the embodiment shown, second end 82 of nozzle 66 has an outer diameter of between seven (7) and ten (10) inches. In other embodiments, second end 82 of nozzle 66 can have a smaller diameter (e.g., between 5 and 7 inches) or a larger diameter (e.g., between 10 and 12 inches.

In the embodiment shown, air spinner 18*a* further comprises an outer support ring 94 coupled to the outer ends of blades 38*a*. In the embodiment shown, outer support ring 94 has a diameter of 32 inches. In other embodiments, the outer support ring and/or the blades can have an outer diameter of between 18 and 36 inches, or larger. In this embodiment, each blade 38*a* is angled relative to the upstream-to-downstream direction (e.g., a plane parallel to and extending outward from axis 90) by an angle θ of between 20 and 45 degrees (e.g., 30 degrees). In other embodiments, angle θ can be greater angle (e.g., between 45 and 75 degrees) or lower (e.g., between 55 and 65 degrees).

In the embodiment shown, nozzle 66 is configured to be (and is shown) mechanically coupled to fuel runner 14 without welding (e.g., via threads). More particularly, in this embodiment, nozzle 66 comprises an spinner adapter 102 having a first end 106 comprises male threads that are configured to engage corresponding female threads encircling the corresponding fuel outlet 34 in fuel runner 14. In this embodiment, spinner adapter also includes a second end 110 comprising female threads configured to engage corresponding male threads on first end 78 of nozzle 66. Hub 58 of air spinner 18*a* can also be configured to be mechanically coupled to the nozzle and the fuel runner without welding. For example, in the depicted embodiment, spinner adapter 102 includes a shoulder 114 spaced from second end 110 by a distance sufficient to receive hub 58 over second end 110, and second end 110 of spinner adapter 102 includes male threads configured to engage female threads of a retainer ring 118 to secure hub 58 between shoulder 114 and retainer ring 118. In other embodiments, retainer ring 118 may be unitary with hub 58, and/or an interior surface of hub 58 may include female threads configured to engage corresponding male threads on adapter 102. In such embodiments, at least some components of the present duct burners may be shipped in a disassembled state for assembly on-site (e.g., for a new installation, or for replacement of worn or defective components). In other embodiments, some or all of the foregoing threads may be omitted in favor of welds, or may be permanently secured with welds to prevent any loosening of threaded connections.

In some embodiments, nozzle 62 may be unitary with hub 58 and/or spinner adapter 102, and/or spinner adapter 102 may be unitary with hub 58, any of which may be formed in a unitary fashion by, for example, layered manufacturing techniques.

Figure 7:
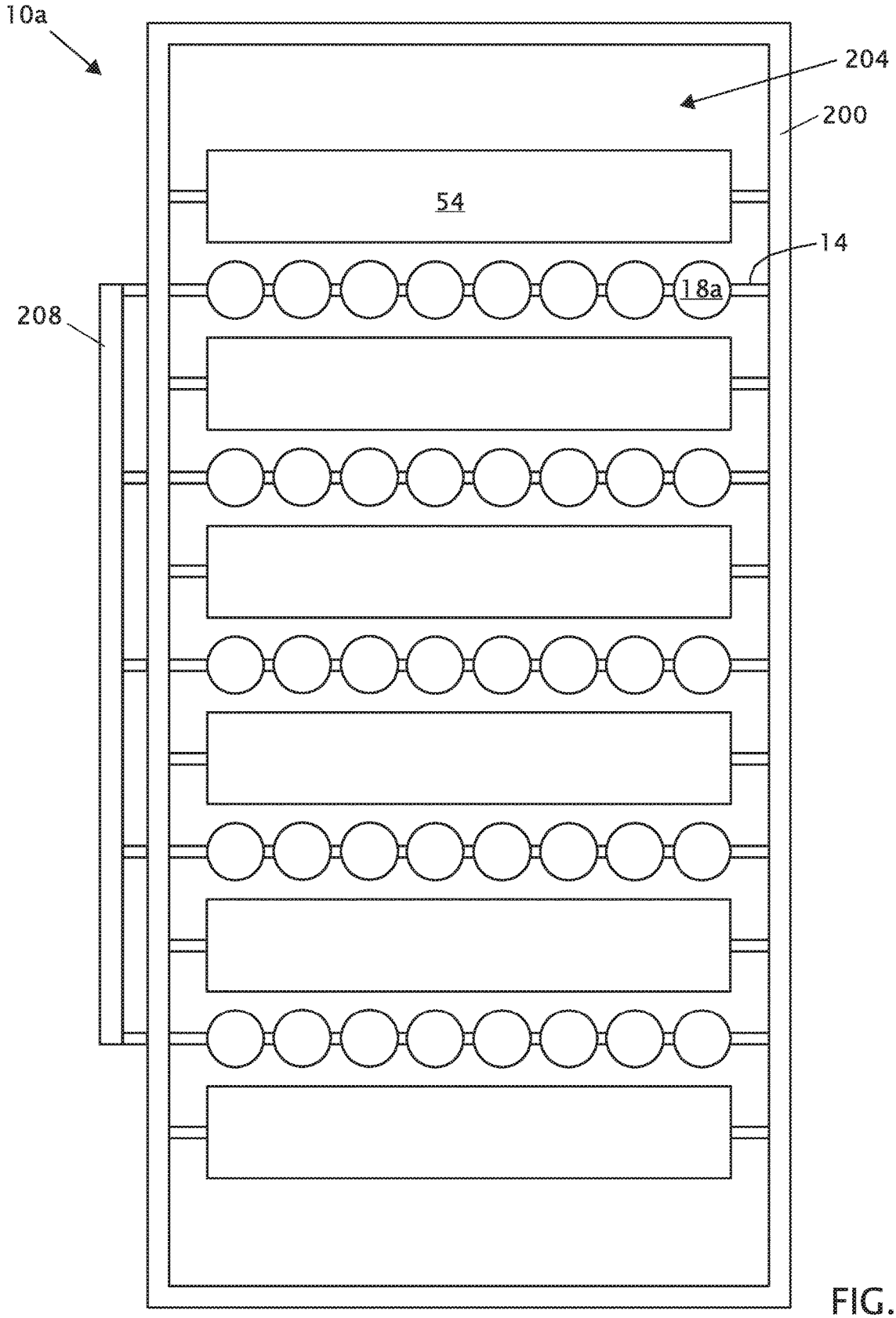
FIG. 7 shows a front view of an embodiment of the present duct burners.

FIG. 7 shows a front view of an embodiment 10*a* of the present duct burners. In the embodiment shown, burner 10*a* comprises a frame 200 defining an opening 204 extending between an inlet first end (facing into the page) and an outlet second end (facing out of the page), and the frame is configured to be coupled to a duct such that air flowing through the duct will flow through the opening in a downstream direction (out of the page) from the first end to the second end. In some embodiments, frame 200 comprises a segment of duct. In the depicted configuration, frame 200 has a width of 30 feet and a height of 60 feet. As shown, burner 10*a* comprises a plurality of fuel runners 14 connected to a manifold 208, and a plurality of air spinners 18*a* coupled to the fuel runners encircling respective ones of the fuel outlets (34) with axes (46) of the respective fuel paths (42) extending disposed at a non-parallel (e.g., perpendicular) angle from an axis (50) of the fuel runner. In the embodiment shown, air spinners 18*a* extend from a downstream side of the fuel runners that is configured to face in a downstream direction of the duct. In this embodiment, burner 10*a* further comprises a plurality of baffles 54 coupled to frame 200 and extending across opening 204 parallel to the fuel runners (14), and at least some of the plurality of baffles are each disposed between two of the fuel runners. In some embodiments, baffles 54 are located between the first end of the frame and of the blades of air spinners 18*a* (upstream of the blades of the air spinners), and between fuel runners 14 and the second end of the frame (downstream of the fuel runners). While horizontal or vertical arrangement of the runners and baffles is possible, the horizontal arrangement shown in FIG. 7 typically provides easier access for maintenance because platforms can be erected horizontally along the components for easier access.

The above description is illustrative and is not restrictive. Many variations of the disclosure will become apparent to those skilled in the art upon review of the disclosure. One or more features from any embodiment described herein may be combined with one or more features of any other embodiment without departing from the scope of the disclosure. The scope of the disclosure should, therefore, be not determined with reference solely to the above description, but instead should be determined with reference to the pending claims along with their full scope or equivalents in view of the above description.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

The invention claimed is:

1. A burner for use in a duct burner system having a duct, the burner comprising:

a frame defining an opening extending between an inlet first end and an outlet second end, the frame configured to be coupled to the duct such that air flowing through the duct will flow through the opening in a downstream direction from the first end to the second end;

a plurality of fuel runners coupled to the frame and extending across the opening of the frame, each of the plurality of fuel runners including a sidewall defining a fuel channel and a plurality of fuel outlets along a length of the fuel runner, each of the plurality of fuel outlets in communication with the fuel channel and extending through the sidewall;

a plurality of air spinners each comprising a plurality of blades extending radially outward from a fuel path having an axis, the plurality of blades configured to impart rotation to air flowing between the blades;

a plurality of baffles coupled to the frame and extending across the opening of the frame parallel to the plurality of fuel runners, at least some of the plurality of baffles each disposed between two of the fuel runners;

where each of the plurality of air spinners is coupled to one of the plurality of fuel runners such that the air spinner encircles one of the plurality of fuel outlets with the axis of the fuel path extending at a non-parallel angle from an axis of the fuel runner, and where the baffles are located between the first end of the frame and of the blades of the air spinners, and between the fuel runners and the second end of the frame.

2. The burner of claim 1, wherein each of the plurality of air spinners is coupled to one of the plurality of fuel runners such that the axis of the fuel path extends at a perpendicular angle from the axis of the fuel runner.

3. The burner of claim 1, wherein the plurality of air spinners extend from a downstream side of the fuel runners that is configured to face in a downstream direction of the duct.

4. The burner of claim 1, further comprising a plurality of nozzles each coupled to one of the fuel runners in communication with one of the plurality of fuel outlets.

5. The burner of claim 4, wherein each nozzle comprises a body having a sidewall that defines a nozzle channel extending between an open first end and a substantially closed second end, the first end coupled to the fuel runner with the nozzle channel in communication with the fuel outlet, the body defining a plurality of fuel passages extending through the sidewall at a non-parallel angle to an axis of the nozzle channel.

6. The burner of claim 5, wherein each of the plurality of nozzles is configured such that axes of the plurality of fuel passages do not intersect the axis of the nozzle channel.

7. The burner of claim 6, wherein each of the plurality of nozzles is configured such that the axes of the plurality of fuel passages are tangential to a circular cylinder centered on the axis of the nozzle channel.

8. The burner of claim 5, wherein each of the plurality of nozzles is mechanically coupled to the fuel runner via threads.

9. A burner kit for use in a high capacity burner duct system having a duct, the burner kit comprising:

a plurality of fuel runners configured to be coupled to a frame and configured to extend across an opening of the frame, each of the plurality of fuel runners including a sidewall defining a fuel channel and a plurality of fuel outlets along a length of the fuel runner, each of the plurality of fuel outlets in communication with the fuel channel and extending through the sidewall; and a plurality of air spinners each comprising a plurality of blades extending radially outward from a fuel path having an axis, the plurality of blades configured to impart rotation to air flowing between the blades;

wherein the frame defines an opening extending between an inlet first end and an outlet second end, and the frame comprises a plurality of baffles extending across the opening of the frame parallel to the plurality of fuel runners, at least some of the plurality of baffles each disposed between two of the fuel runners, and further wherein the baffles are located between the first end of the frame and of the blades of the air spinners, and between the fuel runners and the second end of the frame; and where each of the plurality of air spinners is coupled to one of the plurality of fuel runners such that the air spinner encircles one of the plurality of fuel outlets with the axis of the fuel path extending at a non-parallel angle from an axis of the fuel runner.

10. The burner kit of claim 9 further comprising a plurality of nozzles each configured to be coupled to one of the fuel runners in communication with one of the plurality of fuel outlets.

11. The burner kit of claim 10 wherein each nozzle comprises a body having a sidewall that defines a nozzle channel extending between an open first end and a substantially closed second end, the first end coupled to the fuel runner with the nozzle channel in communication with the fuel outlet, the body defining a plurality of fuel passages extending through the sidewall at a non-parallel angle to an axis of the nozzle channel.

12. The burner kit of claim 11, wherein each of the plurality of nozzles is configured such that axes of the plurality of fuel passages do not intersect the axis of the nozzle channel.

13. The burner kit of claim 12, wherein each of the plurality of nozzles is configured such that the axes of the plurality of fuel passages are tangential to a circular cylinder centered on the axis of the nozzle channel.

14. The burner kit of claim 11, wherein each of the plurality of nozzles is configured to be mechanically coupled to the fuel runner via threads.

* * * * *